US012320092B2

(12) United States Patent
Noda et al.

(10) Patent No.: US 12,320,092 B2
(45) Date of Patent: Jun. 3, 2025

(54) SYSTEM FOR SETTING TARGET TRAJECTORY OF ATTACHMENT

(71) Applicant: KOBELCO CONSTRUCTION MACHINERY CO., LTD., Hiroshima (JP)

(72) Inventors: Daisuke Noda, Hiroshima (JP); Koji Yamashita, Hiroshima (JP); Masaki Akiyama, Hiroshima (JP)

(73) Assignee: KOBELCO CONSTRUCTION MACHINERY CO., LTD., Hiroshima (JP)

( * ) Notice: Subject to any disclaimer, the term of this patent is extended or adjusted under 35 U.S.C. 154(b) by 265 days.

(21) Appl. No.: 18/246,298

(22) PCT Filed: Aug. 5, 2021

(86) PCT No.: PCT/JP2021/029078
§ 371 (c)(1),
(2) Date: Mar. 22, 2023

(87) PCT Pub. No.: WO2022/070606
PCT Pub. Date: Apr. 7, 2022

(65) Prior Publication Data

US 2023/0374749 A1 Nov. 23, 2023

(30) Foreign Application Priority Data

Sep. 29, 2020 (JP) ..... 2020-162945

(51) Int. Cl.
*E02F 3/43* (2006.01)
*E02F 3/32* (2006.01)
(Continued)

(52) U.S. Cl.
CPC ..... *E02F 3/437* (2013.01); *E02F 3/32* (2013.01); *E02F 3/439* (2013.01); *E02F 9/10* (2013.01); *E02F 9/262* (2013.01)

(58) Field of Classification Search
CPC ..... E02F 3/34; E02F 9/20; G05D 1/02
See application file for complete search history.

(56) References Cited

U.S. PATENT DOCUMENTS

2014/0261152 A1 9/2014 Tanaka et al.
2016/0281323 A1 9/2016 Imaizumi
(Continued)

FOREIGN PATENT DOCUMENTS

JP 62-21 4407 A 9/1987
JP 9-256407 A 9/1997
(Continued)

OTHER PUBLICATIONS

Extended European Search Report issued Jan. 18, 2024, in corresponding European Patent Application No. 21874909.1, 6 pages.
(Continued)

*Primary Examiner* — Tan Q Nguyen
(74) *Attorney, Agent, or Firm* — Oblon, McClelland, Maier & Neustadt, L.L.P.

(57) ABSTRACT

A system for setting a target trajectory of an attachment allows for an efficient operation of the attachment. The system includes a target trajectory setting unit which sets a target trajectory of a specific part of an attachment between a target start point at which an operation for moving the attachment holding a load extracted from a work object to above an object to be loaded is started and a target end point at which this operation is finished, an imaging device which images the surroundings of a work machine including the object to be loaded as ambient information, an end point moving unit which moves the target end point based on the
(Continued)

ambient information, and a target trajectory resetting unit which resets the target trajectory between the target start point and a target end point after movement.

15 Claims, 12 Drawing Sheets

(51) Int. Cl.

| | |
|---|---|
| ***E02F 9/10*** | (2006.01) |
| ***E02F 9/26*** | (2006.01) |
| *G05D 1/02* | (2020.01) |

(56) References Cited

U.S. PATENT DOCUMENTS

| | | | | |
|---|---|---|---|---|
| 2017/0298591 | A1 | 10/2017 | Imaizumi et al. | |
| 2018/0251956 | A1 | 9/2018 | Hoshaku et al. | |
| 2020/0181881 | A1 | 6/2020 | Graves | |
| 2024/0052603 | A1* | 2/2024 | Yoshida | E02F 9/2045 |

FOREIGN PATENT DOCUMENTS

| | | | |
|---|---|---|---|
| JP | 10-204925 | A | 8/1998 |
| JP | 2017-44027 | A | 3/2017 |
| JP | 2019-19567 | A | 2/2019 |
| WO | WO 2013/058247 | A1 | 4/2013 |
| WO | WO 2016/152994 | A1 | 9/2016 |
| WO | WO 2019/181872 | A1 | 9/2019 |
| WO | WO 2019/189013 | A1 | 10/2019 |

OTHER PUBLICATIONS

International Search Report mailed on Oct. 5, 2021 in PCT/JP2021/029078 filed on Aug. 5, 2021 (3 pages).

* cited by examiner

SYSTEM FOR SETTING TARGET TRAJECTORY OF ATTACHMENT

TECHNICAL FIELD

The present invention relates to a system for setting a target trajectory of an attachment, the system sets the target trajectory of a specific part of the attachment of a work machine.

BACKGROUND ART

Conventionally, as disclosed in Patent Literature 1, a target orientation of an attachment of a hydraulic excavator between a soil discharging position and an excavation point is taught in advance, and the target orientation is sequentially read to automatically operate the attachment.

CITATION LIST

Patent Literature

Patent Literature 1: JP S62-214407 A

At a work site, every time an object to be loaded (dump truck or the like) that allows a load (earth and sand or the like) to be loaded goes back and force to near the work machine, the position of the object to the loaded may change. The object to be loaded has a plurality of different sizes. Therefore, when the attachment is operated based on the content taught in advance, there is a problem that the attachment cannot reach the object to be loaded and the work becomes inefficient.

SUMMARY OF INVENTION

An object of the present invention is to provide a system for setting a target trajectory of an attachment, the system allowing for an efficient operation of the attachment.

The present invention is a system for setting a target trajectory of an attachment used in a work machine including a lower travelling body, an upper slewing body slewably attached to an upper part of the lower travelling body, and an attachment attached to the upper slewing body. The system for setting a target trajectory includes a target trajectory setting unit, an imaging device, an end point moving unit, and a target trajectory resetting unit. The target trajectory setting unit sets a target start point which is a start point of a specific part of the attachment in a first specific operation of the attachment moving a load acquired from a work object to above an object to be loaded, a target end point which is an end point of the specific part in the first operation, and a target trajectory of the specific part between the target start point and the target end point. The imaging device is configured to capture an image of surroundings of the work machine including at least the object to be loaded as ambient information. The end point moving unit is configured to move the target end point set by the target trajectory setting unit based on the ambient information imaged by the imaging device. The target trajectory resetting unit resets the target trajectory between the target start point and the target end point after movement.

DESCRIPTION OF EMBODIMENTS

Hereinafter, preferred embodiments of the present invention will be described with reference to the drawings.

(Configuration of System for Setting Target Trajectory)

Figure 1:
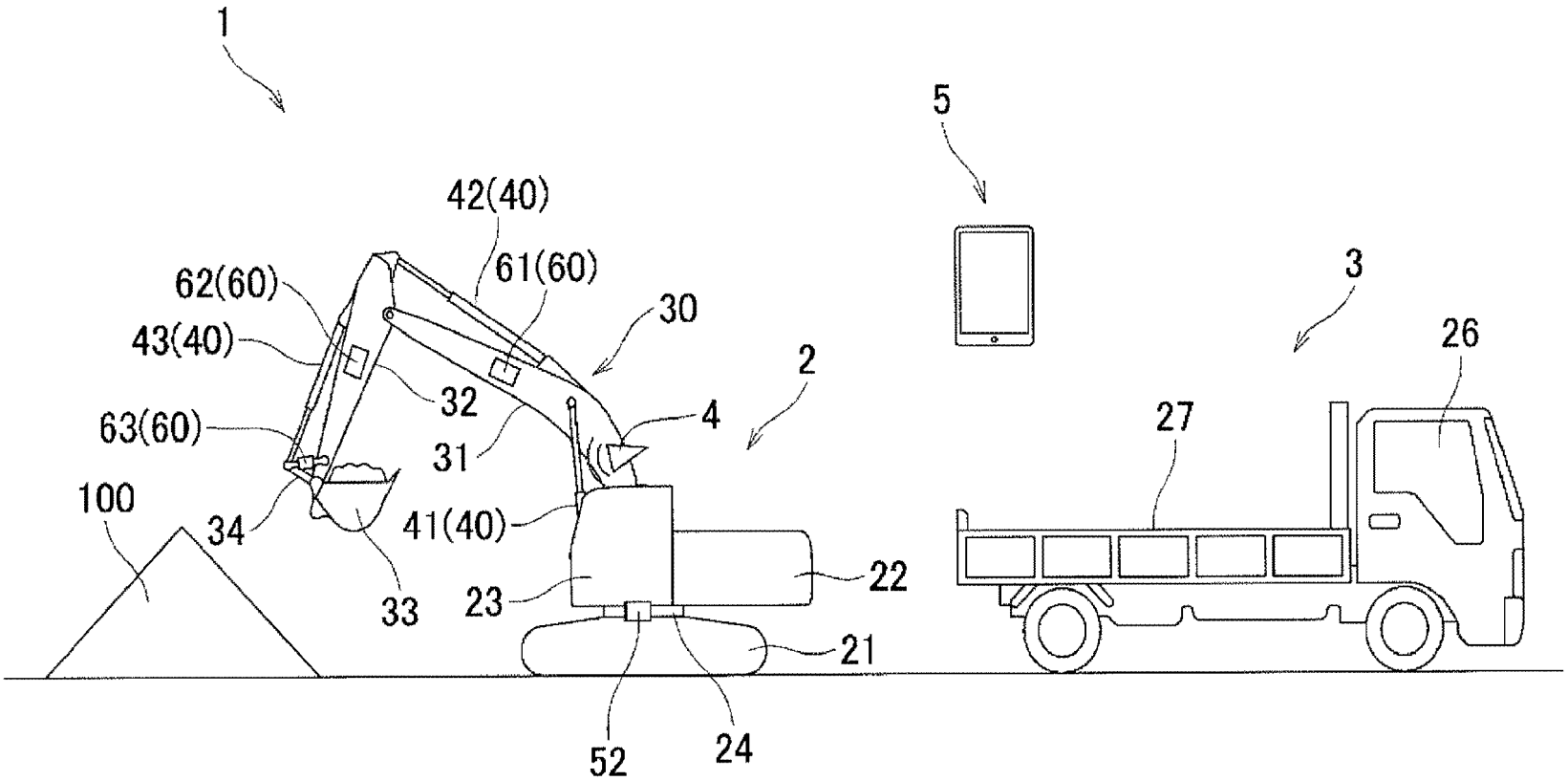
FIG. 1 is a configuration diagram of a system for setting a target trajectory according to one embodiment of the present invention.

A system for setting a target trajectory (system for changing a target trajectory) of an attachment according to the present embodiment sets and changes a target trajectory of a specific part of an attachment of a work machine. FIG. 1 is a configuration diagram of a system 1 for setting a target trajectory according to one embodiment of the present invention. As shown in FIG. 1, the system 1 for setting a target trajectory has a portion included in a work machine 2, an imaging device 4, and a mobile terminal 5. Note that, in another embodiment, the system 1 for setting a target trajectory does not need to have the mobile terminal 5.

(Configuration of Work Machine)

As shown in FIG. 1, the work machine 2 is a machine that performs work with an attachment 30, and is, for example, a hydraulic excavator. The work machine 2 has a lower travelling body 21, an upper slewing body 22, a slewing device 24, the attachment 30, and a cylinder 40.

The lower travelling body 21 is a portion that causes the work machine 2 to travel, and includes, for example, a crawler. The upper slewing body 22 is slewably attached to an upper part of the lower travelling body 21. A cab (operation room) 23 is provided in a front portion of the upper slewing body 22. The slewing device 24 can slew the upper slewing body 22.

The attachment 30 is attached to the upper slewing body 22 so as to be vertically pivotable. The attachment 30 includes a boom 31, an arm 32, and a bucket 33. The boom 31 is attached to the upper slewing body 22 so as to be vertically pivotable. The arm 32 is attached to the boom 31 so as to be vertically pivotable. The bucket 33 is attached to the arm 32 so as to be vertically pivotable.

The bucket 33 is a portion that excavates, holds, and drops (releases) earth and sand which is a load. Note that the bucket 33 is an example of a distal end attachment attached to the arm 32. The distal end attachment is not limited thereto, and may be a nibbler, a clamp arm, or the like. In addition, the load is not limited to earth and sand, and may be rubble, iron waste, gravel, or the like.

The cylinder 40 can hydraulically pivot the attachment 30. The cylinder 40 is a hydraulic telescopic cylinder. The cylinder 40 includes a boom cylinder 41, an arm cylinder 42, and a bucket cylinder 43.

The boom cylinder 41 rotationally drives the boom 31 with respect to the upper slewing body 22. The boom cylinder 41 has a proximal end pivotably attached to the upper slewing body 22. The boom cylinder 41 has a distal end pivotably attached to the boom 31.

The arm cylinder 42 rotationally drives the arm 32 with respect to the boom 31. The arm cylinder 42 has a proximal end pivotably attached to the boom 31. The arm cylinder 42 has a distal end pivotably attached to the arm 32.

The bucket cylinder 43 rotationally drives the bucket 33 with respect to the arm 32. The bucket cylinder 43 has a proximal end pivotably attached to the arm 32. The distal end of the bucket cylinder 43 is pivotably attached to a link member 34 pivotably attached to the bucket 33.

The work machine 2 further includes an operation lever 51 (see FIG. 2), an angle sensor 52, and an inclination angle sensor 60.

The operation lever 51 is operated by an operator to operate the slewing device 24 and the attachment 30. The operation lever 51 is provided in the cab 23.

The angle sensor 52 detects a slewing angle of the upper slewing body 22 with respect to the lower travelling body 21. The angle sensor 52 is, for example, an encoder, a resolver, or a gyro sensor. In the present embodiment, the slewing angle of the upper slewing body 22 when a front side of the upper slewing body 22 coincides with a front side of the lower travelling body 21 is 0°.

The inclination angle sensor 60 detects an orientation of the attachment 30. The inclination angle sensor 60 includes a boom inclination angle sensor 61, an arm inclination angle sensor 62, and a bucket inclination angle sensor 63.

The boom inclination angle sensor 61 is attached to the boom 31 and detects an orientation of the boom 31. The boom inclination angle sensor 61 is a sensor that acquires an inclination angle of the boom 31 with respect to the horizontal line, and is, for example, an inclination (acceleration) sensor or the like. Note that the boom inclination angle sensor 61 may be a rotation angle sensor that detects a rotation angle of a boom foot pin (boom proximal end) or a stroke sensor that detects a stroke amount of the boom cylinder 41.

The arm inclination angle sensor 62 is attached to the arm 32 and detects an orientation of the arm 32. The arm inclination angle sensor 62 is a sensor that acquires an inclination angle of the arm 32 with respect to the horizontal line, and is, for example, an inclination (acceleration) sensor or the like. Note that the arm inclination angle sensor 62 may be a rotation angle sensor that detects a rotation angle of an arm connection pin (boom proximal end) or a stroke sensor that detects a stroke amount of the arm cylinder 42.

The bucket inclination angle sensor 63 is attached to the link member 34 and detects an orientation of the bucket 33. The bucket inclination angle sensor 63 is a sensor that acquires an inclination angle of the bucket 33 with respect to the horizontal line, and is, for example, an inclination (acceleration) sensor or the like. Note that the bucket inclination angle sensor 63 may be a rotation angle sensor that detects a rotation angle of a bucket connection pin (bucket proximal end) or a stroke sensor that detects a stroke amount of the bucket cylinder 43.

(Configuration of Dump Truck)

As shown in FIG. 1, earth and sand held by the work machine 2 is loaded on a dump truck 3. The dump truck 3 has an operation room 26 and a platform 27. The platform 27 of the dump truck 3 is an object to be loaded of the present embodiment.

(Configuration of Imaging Device)

As shown in FIG. 1, the imaging device 4 is attached to the work machine 2. Note that the imaging device 4 may be installed at a place away from the work machine 2 (for example, a part of a work site). In the present embodiment, the imaging device 4 is a LIDAR, and images the surroundings of the work machine 2 including at least the platform 27 of the dump truck 3 as ambient information. Note that the imaging device 4 may be a camera, an ultrasonic sensor, a millimeter wave radar, a stereo camera, a distance image sensor, an infrared sensor, or the like.

(Configuration of Mobile Terminal)

As shown in FIG. 1, the mobile terminal 5 is a terminal operated by a worker at a work site, and is, for example, a, tablet terminal. The mobile terminal 5 is communicable with the work machine 2. Note that the mobile terminal 5 may be a smartphone or the like.

(Circuit Configuration of System for Setting Target Trajectory)

Figure 2:
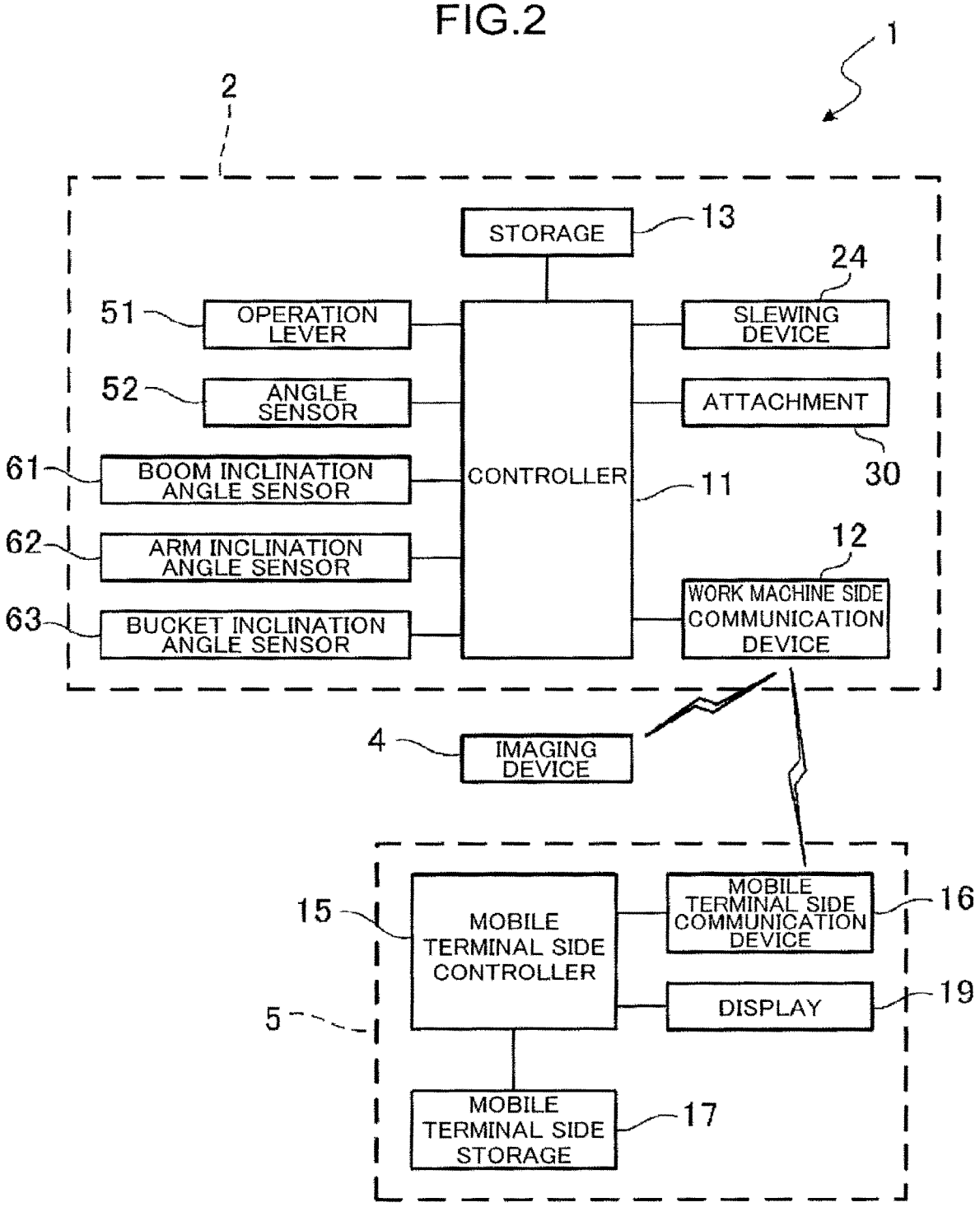
FIG. 2 is a block diagram of a system for setting a target trajectory according to one embodiment of the present invention.

FIG. 2 is a block diagram of the system 1 for setting a target trajectory according to the present embodiment. As shown in FIG. 2, the work machine 2 includes a controller 11, a work machine side communication device 12, and a storage 13. These components constitute a part of the system 1 for setting a target trajectory.

The controller 11 includes a central processing unit (CPU), a read only memory (ROM) that stores a control program, random access memory (RAM) used as a work area for the CPU, and the like. By the CPU executing the control program stored in the ROM, the controller 11 functions so as to include a target trajectory setting unit, an end point moving unit, a target trajectory resetting unit, an avoidance point setting unit, a target return trajectory setting unit, a return start point moving unit, a target return trajectory resetting unit, a return avoidance point setting unit, and a releasing position setting unit of the present invention.

Figure 3:
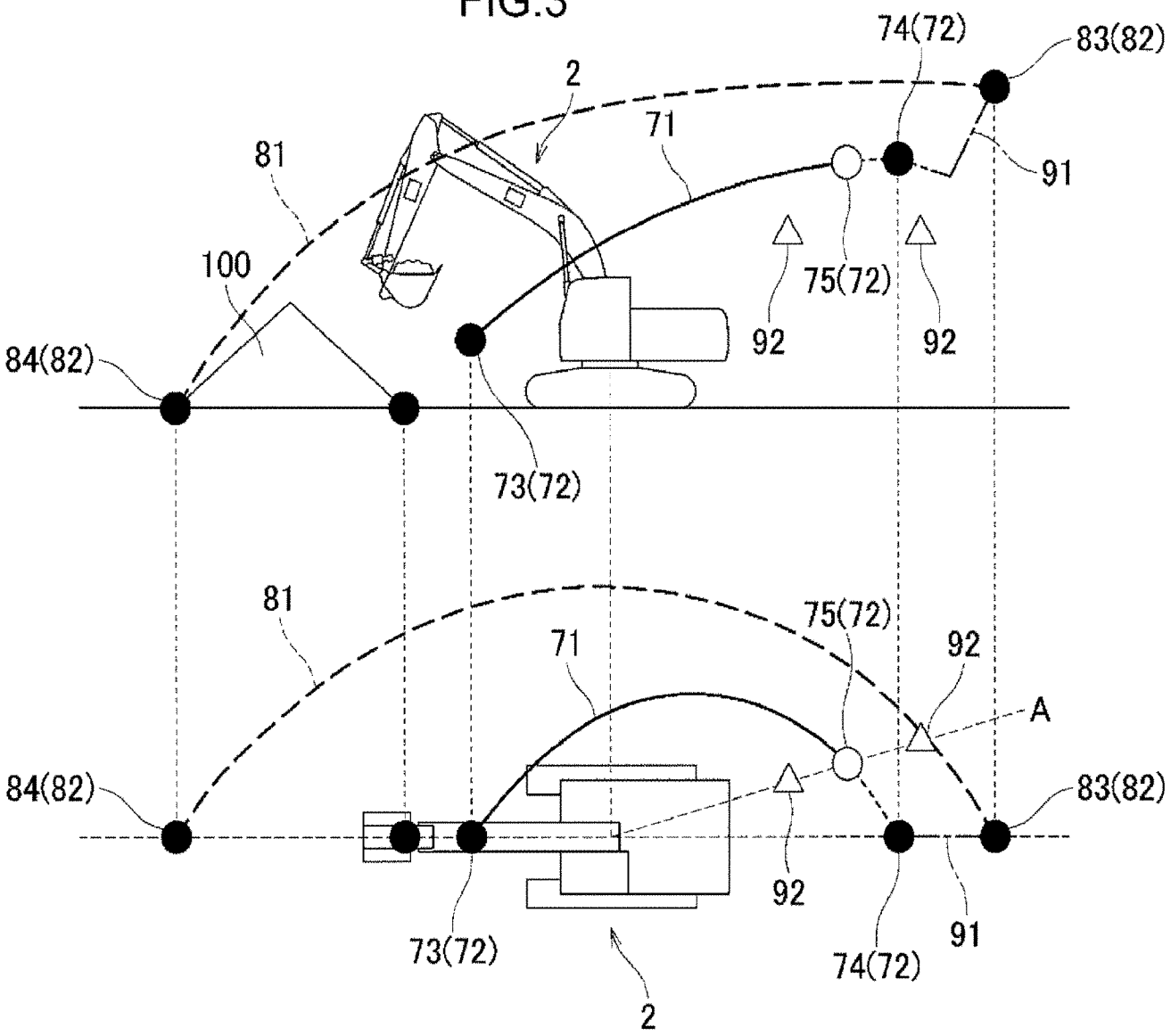
FIG. 3 is a diagram of a target trajectory and a target return trajectory of a distal end of a bucket according to one embodiment of the present invention, and is a diagram in a case where the target trajectory is reset to decrease a slewing angle of an upper stewing body.

FIG. 3 is a diagram of a target trajectory 71 of a distal end of the bucket 33 according to the present embodiment. As shown in FIG. 3, the controller (target trajectory setting unit) 11 sets the target trajectory 71 of the distal end of the bucket 33 between a target start point 73 and a target end point 74. As an example, the target trajectory 71 is a curve, and in particular, in the present embodiment, the target trajectory 71 is an arc (may be a quadratic curve or the like). In addition, the controller 11 sets target points 72 at specific intervals on the target trajectory 71. Here, the specific interval may be a specific time interval or a specific distance interval. The time interval and the distance interval may be constant, or may be set to change in accordance with a relationship with the target start point and the target end point.

The target trajectory 71 according to the present embodiment is a target trajectory during lifting and slewing. The lifting and stewing is an operation of slewing the upper stewing body 22 in a state where the bucket 33 is holding scooped earth and sand. That is, the lifting and slewing is an operation of moving the attachment 30 holding the earth and sand acquired from a soil mound 100 as a work object to above the platform 27 of the dump truck 3. The target point 72 closest to the soil mound 100 is the target start point 73 at which this operation is started, and the target point 72 farthest from the soil mound 100 is the target end point 74 at which this operation is finished.

Here, the distal end of the bucket 33 is an example of a specific part of the attachment 30. Note that the specific part of the attachment 30 is not limited thereto, and may be, for example, a distal end of the arm 32 or the like.

As shown in FIG. 3, the controller (target return trajectory setting unit) 11 sets a target return trajectory 81 of the distal end of the bucket 33 between a target return start point 83 and a target return end point 84. In addition, the controller 11 sets target return points 82 at specific intervals on the target return trajectory 81. Here, the specific interval may be a specific time interval or a specific distance interval. The time interval and the distance interval may be constant, or may be set to change in accordance with a relationship with the target start point and the target end point.

The target return trajectory 81 according to the present embodiment is a target trajectory during return slewing. The return stewing is an operation of returning the bucket 33 to an excavation point by slewing the upper slewing body 22 after discharging the earth and sand held by the bucket 33. That is, the return slewing is an operation of moving the attachment 30 that has released the earth and sand from above the platform 27 of the dump truck 3 to around the sail mound 100. The target return point 82 farthest from the soil mound 100 is the target return start point 83 at which this operation is started, and the target return point 82 closest to the soil mound 100 is the target return end point 84 at which this operation is finished.

FIG. 3 shows the target trajectory 71 and the target return trajectory 81 when the work machine 2 is viewed from a side, and the target trajectory 71 and the target return trajectory 81 when the work machine 2 is viewed from above. The dump truck 3 (not shown) is located on the right side of the work machine 2 in the drawing.

Here, in the present embodiment, the target trajectory 71 and the target return trajectory 81 are set by teaching for actually operating the work machine 2 (online teaching). Specifically, the operator operates the operation lever 51 to operate the slewing device 24 and the attachment 30. The stewing angle of the upper stewing body 22 at this time is detected by the angle sensor 52. In addition, the orientation of the attachment 30 at this time is detected by the inclination angle sensor 60. The controller 11 sets the target trajectory 71 and the target return trajectory 81 based on the detected slewing angle of the upper slewing body 22 and the detected orientation of the attachment 30. Here, the specific interval is a sampling interval of detection values from the angle sensor 52 and the inclination angle sensor 60.

Note that the target trajectory 71 and the target return trajectory 81 may be set by the worker, another computer, or the like inputting information on the slewing angle of the upper stewing body 22 and information on the orientation of the attachment 30 to the controller 11 without actually operating the work machine 2 (off-line teaching). In this case, the target trajectory 71 and the target return trajectory 81 may be set by inputting information at specific intervals to the controller 11.

On the right side in FIG. 3, the target trajectory 71 and the target return trajectory 81 are connected by a target soil discharging trajectory 91 at a time of soil discharge. On the left side in FIG. 3, the target trajectory 71 and the target return trajectory 81 are connected by a target excavation trajectory (not shown) at a time of excavation.

After reaching the target end point 74, the distal end of the bucket 33 is moved to a soil discharging position, and soil is discharged (earth and sand is dropped) at the soil discharging position. The soil discharging position is set above the platform 27 of the dump truck 3. Note that the soil discharging position will be described later in detail.

As described above, the imaging device 4 captures an image of the surroundings of the work machine 2 including at least the platform 27 of the dump truck 3 as the ambient information. The controller (end point moving unit) 11 moves the target end point 74 of the target trajectory 71 based on the imaged ambient information. In FIG. 3, the target end point 74 before movement is indicated by a black circle (●), and the target end point 75 after movement is indicated by a white circle (○).

When the target end point 74 is moved, the controller (target trajectory resetting unit) 11 resets the target trajectory 71 between the target start point 73 and the target end point 75 after movement. In FIG. 3, the soil discharging position 92, which is a movement destination to which the bucket 33 moves from the target end point 75 after movement, is indicated by a white triangle (Δ). Each of the drawings including FIG. 3 shows two soil discharging positions 92. As the two soil discharging positions 92, the drawings show the soil discharging position 92 closest to the work machine 2 and the soil discharging position 92 farthest from the work machine 2 among the plurality of soil discharging positions 92 described later. The controller 11 specifies the position of the platform 27 based on the ambient information imaged by the imaging device 4, and sets the plurality of soil discharging positions 92, for example, along a center line of the platform 27. When the work machine 2 loads earth and sand of the soil mound 100 on the platform 27 for the first time, the bucket 33 is moved from the target end point 75 to the soil discharging position 92 closest to the work machine 2.

Here, with reference to FIG. 3, a case will be considered where the platform 27 of the dump truck 3 is located upstream of the target end point 74 before movement in a stewing direction of the upper slewing body 22. That is, a case will be considered where a longitudinal direction of the platform 27 is along a dotted line A (the center line of the platform 27) in the drawing. In other words, the dotted line A is a line connecting the two soil discharging positions 92.

In this case, the controller 11 moves the target end point 74 to upstream in the slewing direction of the upper slewing body 22 corresponding to the platform 27. In the present embodiment, the controller 11 moves the target end point 74 to the target point 72 located at an intersection of a straight line connecting the two soil discharging positions 92 and the target trajectory 71. In a case where the slewing angle of the upper slewing body 22 from a state where a front surface of the upper slewing body 22 faces the soil mound 100 to the soil discharging position 92 on the right side in the drawing and the slewing angle of the upper slewing body 22 to the soil discharging position 92 on the left side in the drawing are different depending on the direction of the dump truck 3 (platform 27), the target end point 74 may be moved to the target point 72 (point on the target trajectory 71) corresponding to the smaller slewing angle of the above two slewing angles. Although the two slewing angles are the same in FIG. 3, the two stewing angles may be different depending on the direction of the platform 27 as described above. In FIG. 3, the target end point 75 after movement is located upstream of the target end point 74 before movement in the slewing direction.

Furthermore, the controller 11 resets the target trajectory 71 to decrease the slewing angle of the upper slewing body 22. In FIG. 3, the slewing angle from the state where the front surface of the upper slewing body 22 faces the soil mound 100 to the target end point 75 after movement is smaller than the slewing angle to the target end point 74 before movement.

As described above, in the present embodiment, the controller 11 sets the target trajectory 71 of the distal end of the bucket 33 between the target start point 73 as a start point of the operation of moving the attachment 30 holding the earth and sand acquired from the soil mound 100 to above the platform 27 and the target end point 74 as an end point of this operation. Thereafter, the controller 11 moves the target end point 74 based on the ambient information imaged by the imaging device 4. After the target end point 74 is moved, the controller 11 resets the target trajectory 71 between the target start point 73 and the target end point 75 after movement. After the target trajectory 71 is reset, the distal end of the bucket 33 is operated to follow the target trajectory 71. Thus, the attachment 30 can be efficiently operated by resetting the target trajectory 71.

As shown in FIG. 3, when the platform 27 is located upstream of the target end point 74 before movement in the slewing direction of the upper slewing body 22, the controller 11 moves the target end point 74 to upstream in the slewing direction corresponding to the platform 27. Accordingly, the target trajectory 71 is reset to decrease the slewing angle of the upper slewing body 22. Therefore, the attachment 30 can be moved to above the platform 27 without greatly changing the target trajectory 71.

Figure 4:
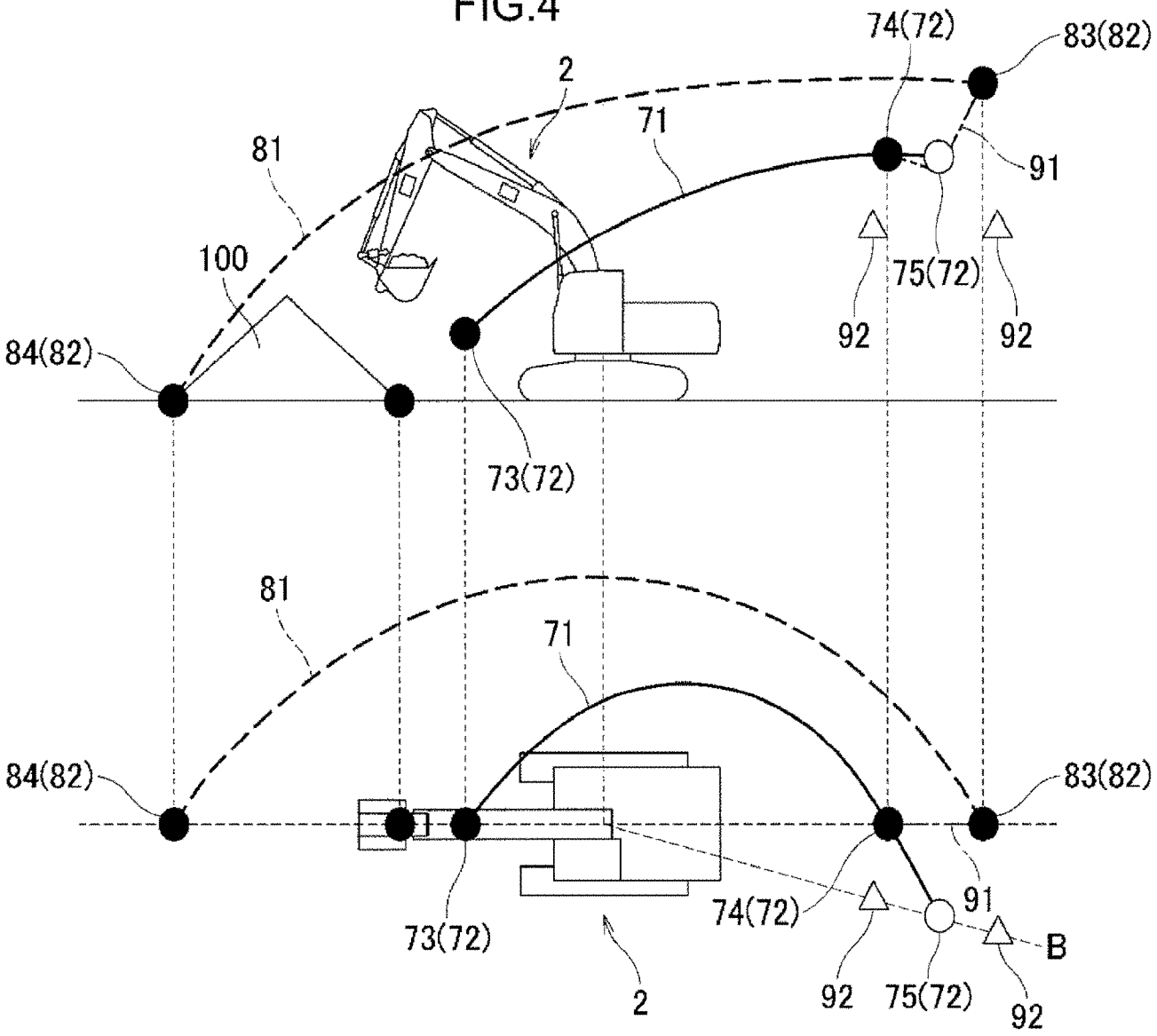
FIG. 4 is a diagram of a target trajectory and a target return trajectory of a distal end of a bucket according to one embodiment of the present invention, and is a diagram in a case where the target trajectory is reset to increase the stewing angle of the upper stewing body.

FIG. 4 is a diagram of the target trajectory 71 and the target return trajectory 81 of the distal end of the bucket 33. As shown in FIG. 4, a case will be considered where the platform 27 of the dump truck 3 is located downstream of the target end point 74 before movement in the slewing direction of the upper slewing body 22. That is, a case will be considered where the longitudinal direction of the platform 27 is along a dotted line B in the drawing. The dotted line B is a line connecting the two soil discharging positions 92.

In this case, the controller 11 moves the target end point 74 to downstream in the slewing direction of the upper slewing body 22 corresponding to the platform 27. In the present embodiment, the controller 11 moves the target end point 74 to the target point 72 located at an intersection of a straight line connecting the two soil discharging positions 92 and the target trajectory 71. In this case as well, in a case where the slewing angle from a state where a front surface of the upper slewing body 22 faces the soil mound 100 to the soil discharging position 92 on the right side in the drawing and the stewing angle to the soil discharging position 92 on the left side in the drawing are different, the target end point 74 may be moved to the target point 72 corresponding to the smaller slewing angle of the above two slewing angles. Although the two slewing angles arc the same in FIG. 4, the two slewing angles are different depending on the direction of the platform 27 in this case as well. In FIG. 4, the target end point 75 after movement is located downstream of the target end point 74 before movement in the slewing direction.

The controller 11 resets the target trajectory 71 to increase the slewing angle of the upper slewing body 22. In FIG. 4, the slewing angle from the state where the front surface of the upper slewing body 22 faces the soil mound 100 to the target end point 75 after movement is larger than the slewing angle from the state where the front surface of the upper slewing body 22 faces the soil mound 100 to the target end point 74 before movement.

In this manner, when the platform 27 is located downstream of the target end point 74 before movement in the slewing direction of the upper slewing body 22, the target end point 74 is moved toward the platform 27 along the slewing direction. Accordingly, the target trajectory 71 is reset to increase the slewing angle of the upper slewing body 22. Therefore, the attachment 30 can be moved to above the platform 27 without greatly changing the target trajectory 71.

Figure 5:
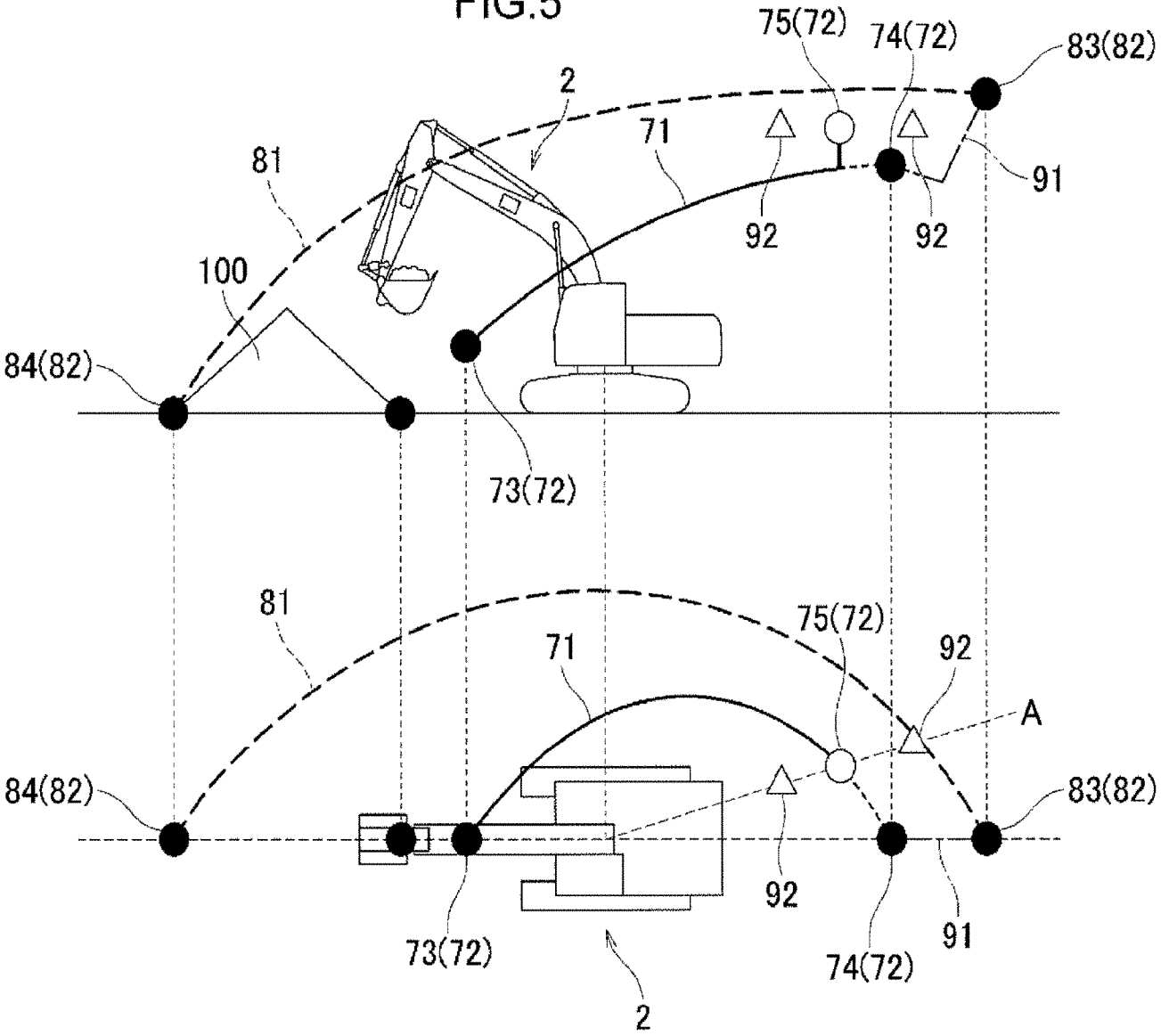
FIG. 5 is a diagram of a target trajectory and a target return trajectory of a distal end of a bucket according to one embodiment of the present invention, and is a diagram in a case where a target end point is moved to above an upper end of a dump truck.

FIG. 5 is a diagram of the target trajectory 71 and the target return trajectory 81 of the distal end of the bucket 33. With reference to FIG. 5, a case will be considered where an upper end of the platform 27 of the dump truck 3 is located above the target end point 74 before movement.

In this case, the controller 11 moves the target end point 74 to above the upper end of the platform 27. In the present embodiment, the controller 11 moves the target end point 74 to above the target point 72 located at the intersection of the straight line connecting the two soil discharging positions 92 and the target trajectory 71 to set the target end point 75 after movement. In a case where the slewing angle from the state where the front surface of the upper slewing body 22 faces the soil mound 100 to the soil discharging position 92 on the right side in the drawing and the slewing angle from the state where the front surface of the upper slewing body 22 faces the soil mound 100 to the soil discharging position 92 on the left side in the drawing are different, the target end point 74 may be moved to above the target point 72 having the smaller slewing angle of the two soil discharging positions. In FIG. 5, the target end point 75 after movement is located above the target end point 74 before movement.

In FIG. 5, as in FIG. 3, the platform 27 is located upstream of the target end point 74 before movement in the slewing direction of the upper slewing body 22. Therefore, in FIG. 5, the target end point 75 after movement is located upstream of the target end point 74 before movement in the slewing direction.

In this manner, when the upper end of the platform 27 is located above the target end point 74 before movement, the target end point 74 is moved to above the upper end of the platform 27. It is therefore possible to prevent the attachment 30 from coming into contact with the platform 27.

Figure 6:
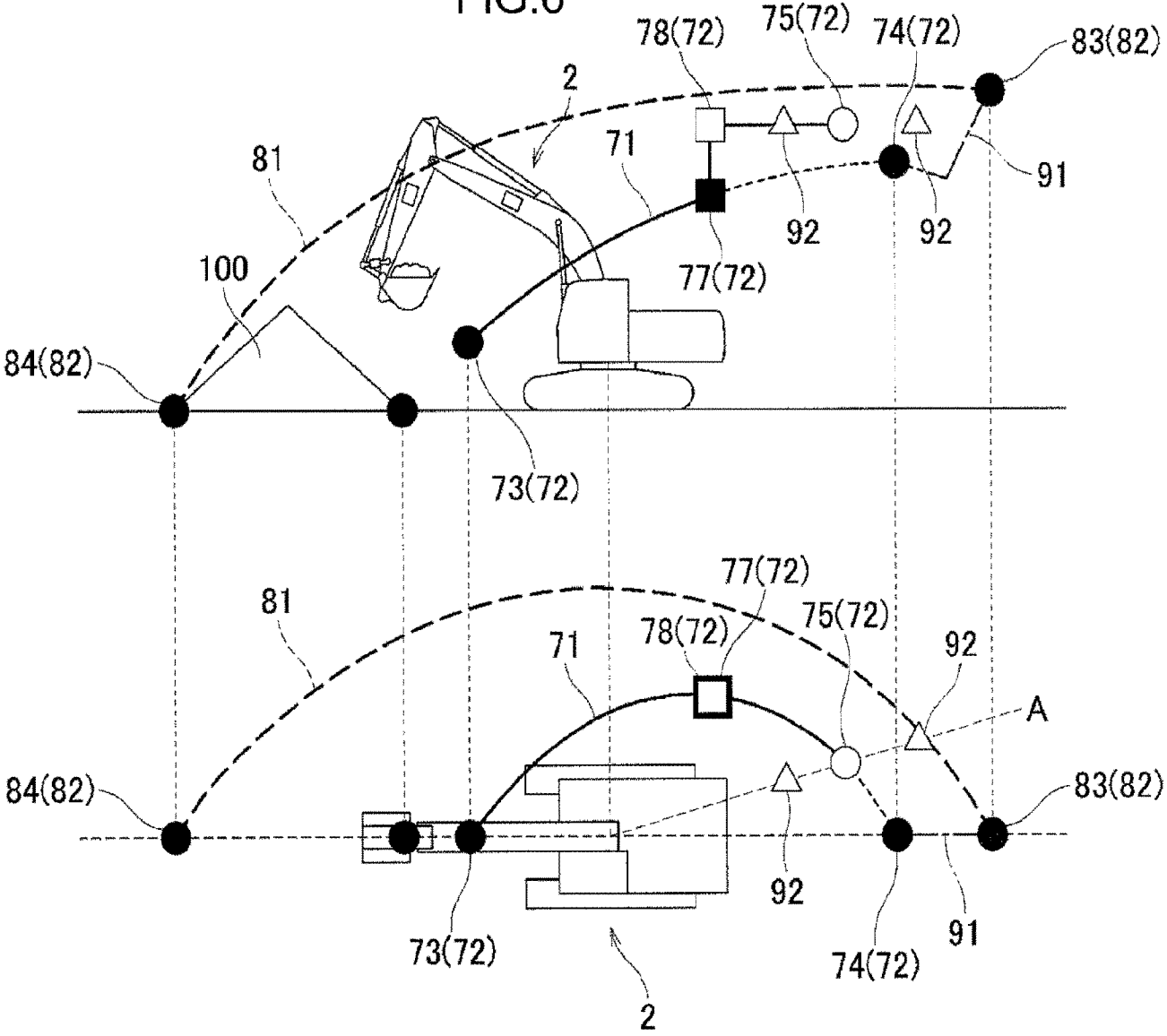
FIG. 6 is a diagram of a target trajectory and a target return trajectory of a distal end of a bucket according to one embodiment of the present invention, and is a diagram in a case where an avoidance point is set above an interference point.

FIG. 6 is a diagram of the target trajectory 71 and the target return trajectory 81 of the distal end of the bucket 33. As shown in FIG. 6, a case will be considered where the upper end of the platform 27 is located above the target end point 74 before movement and the upper end of the platform 27 is located above an interference point 77. Here, the interference point 77 is the target point 72 provided closer to the target start point 73 than the target end point 74 in the set target trajectory 71. The, the interference point 77 corresponds to the target point 72 determined by the controller 11 to possibly interfere with the platform 27 based on the ambient information by the imaging device 4.

In this case, the controller 11 moves the target end point 74 to above the upper end of the platform 27 to set the target end point 75. In addition, the controller (avoidance point setting unit) 11 sets an avoidance point 78 instead of the interference point 77 so as to move the interference point 77 to above the upper end of the platform 27 based on the ambient information by the imaging device 4, In the present embodiment, the avoidance point 78 is set above the interference point 77 before movement in the target trajectory 71. Then, the controller 11 resets the target trajectory 71 so as to pass through the set avoidance point 78.

In FIG. 6, the interference point 77 before movement is indicated by a black square (■), and the set avoidance point 78 is indicated by a white square (□). In FIG. 6, the avoidance point 78 is located above the interference point 77. The height of the reset target trajectory 71 is constant between the avoidance point 78 and the target end point 75 after movement.

In FIG. 6, as in FIG. 3, the platform 27 is located upstream of the target end point 74 before movement in the slewing direction of the upper slewing body 22. Therefore, in FIG. 6, the target end point 75 after movement is located upstream of the target end point 74 before movement in the slewing direction.

Figure 7:
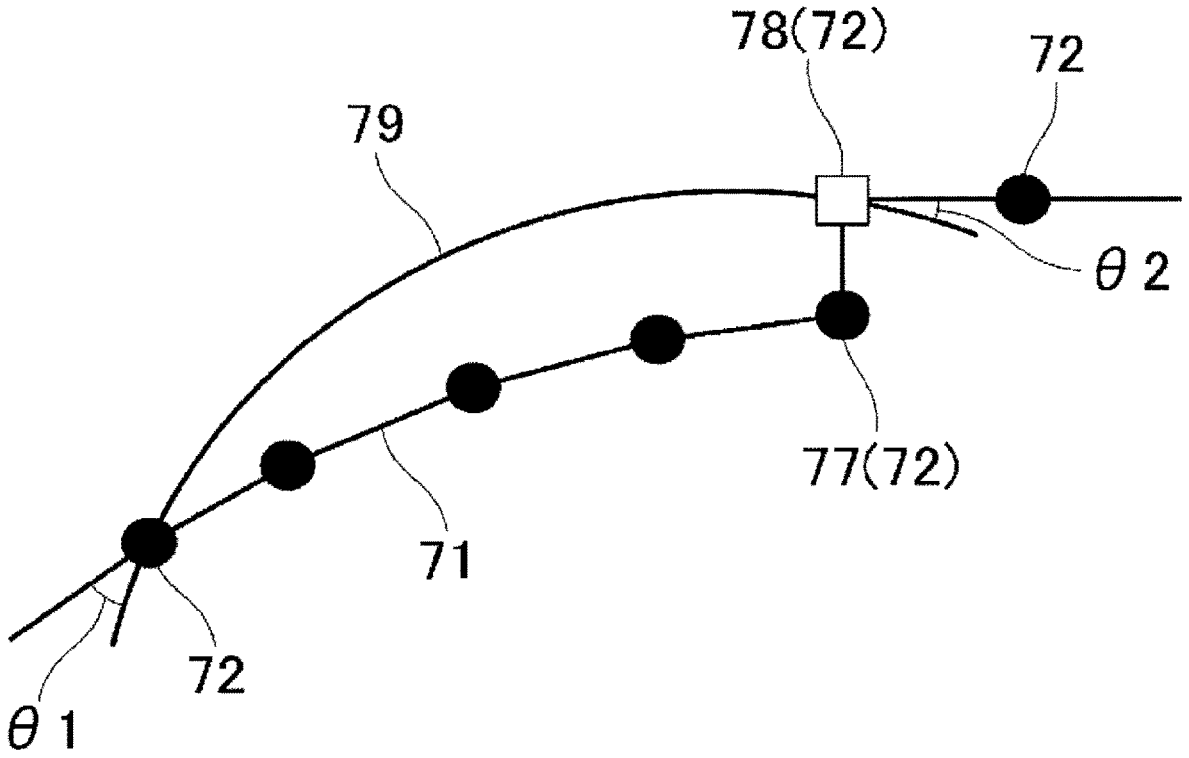
FIG. 7 is a diagram of a target trajectory around an interference point and an avoidance point according to one embodiment of the present invention.

Here, FIG. 7 is a diagram of the target trajectory 71 around the set avoidance point 78. As shown in FIG. 7, in a case where the avoidance point 78 is set above the interference point 77, the controller 11 resets the target trajectory 71 to connect, by a curve, a portion closer to the target start point 73 than the interference point 77 in the target trajectory 71 before resetting and the avoidance point 78. For example, as shown in FIG. 7, the target trajectory 71 is reset to connect the target point 72 upstream of the interference point 77 by four points and the set avoidance point 78 by a quadratic curve 79.

For example, the quadratic curve 79 is desirably determined to have a shape that minimizes the sum of an angle θ1 formed by a tangent of the quadratic curve 79 at the target point 72 (the target point 72 on the leftmost in FIG. 7) which is an intersection point between the quadratic curve 79 and the target trajectory 71, and a tangent of the target trajectory 71, and an angle θ2 formed by a tangent of the quadratic curve 79 at the avoidance point 78 and the target trajectory 71 (straight line) between the avoidance point 78 and the target end point 75 (FIG. 6).

As described above, in the present embodiment, the target point 72 (interference point 77) closer to the target start point 73 than the target end point 74 in the set target trajectory 71 is moved based on the ambient information imaged by the imaging device 4 to set the avoidance point 78. Then, when the upper end of the platform 27 is located above the interference point 77, the avoidance point 78 is moved to above the upper end of the platform 27. It is therefore possible to further prevent the attachment 30 from coming into contact with the platform 27.

In addition, in the present embodiment, the target trajectory 71 is reset to connect, by a curve, a portion of the set target trajectory 71 closer to the target start point 73 than the interference point 77 and the set avoidance point 78. As a result, since rapid movement of the attachment 30 can be suppressed, it is possible to prevent the earth and sand from spilling and the attachment 30 from inefficiently moving.

Figure 8:
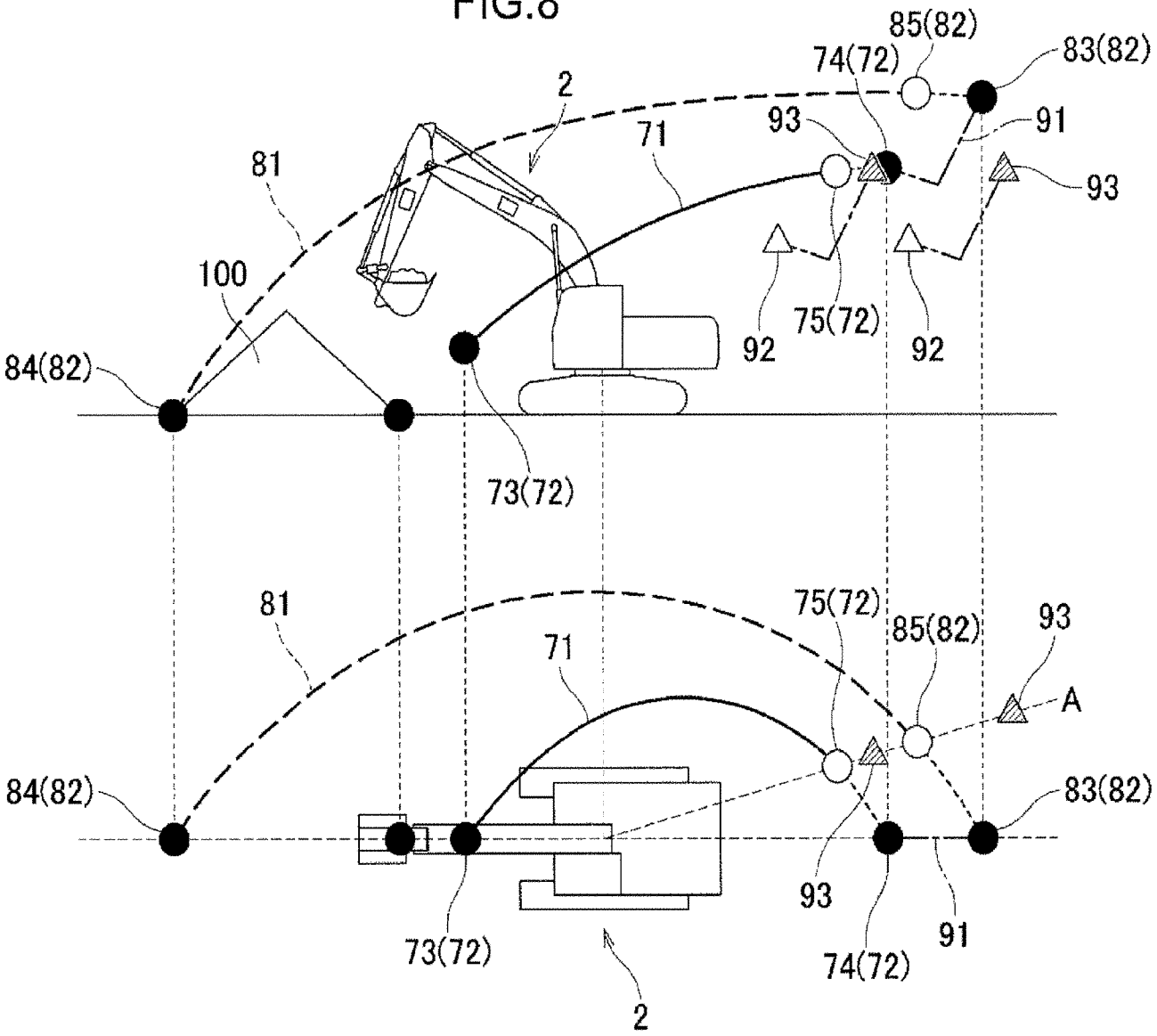
FIG. 8 is a diagram of a target trajectory and a target return trajectory of a distal end of a bucket according to one embodiment of the present invention, and is a diagram in a case where the target return trajectory is reset to decrease the stewing angle of the upper slewing body.

FIG. 8 is a diagram of the target trajectory 71 and the target return trajectory 81 of the distal end of the bucket 33. As shown in FIG. 8, the controller (return start point moving unit) 11 can move the target return start point 83 of the target return trajectory 81 based on the ambient information by the imaging device 4. When the target return start point 83 is moved, the controller (target return trajectory resetting unit) 11 resets the target return trajectory 81 between the target return end point 84 and the target return start point 85 after movement.

Here, with reference to FIG. 8, a case will be considered where the platform 27 of the dump truck 3 is located upstream of the target return start point 83 before movement in the stewing direction of the upper stewing body 22. In this case, as described above with reference to FIG. 3, the target trajectory 71 is reset. The distal end of the bucket 33 moves from the target end point 75 after movement to the soil discharging position 92, follows the target soil discharging trajectory 91, and reaches a position 93 indicated by a triangle (▲). Since the position 93 and the target return start point 83 are separated from each other, moving the distal end of the bucket 33 from the position 93 to the target return start point 83 will be a detour.

Therefore, the controller 11 moves the target return start point 83 toward the platform 27 along the slewing direction of the upper slewing body 22 to set the target return start point 85. In the present embodiment, the target return start point 85 to the target return point 82 located at the intersection of the straight line connecting the two positions 93 and the target return trajectory 81. In this case as well, in a case where the slewing angle from the state where the front surface of the upper stewing body 22 faces the soil mound 100 to the position 93 on the right side in the drawing and the stewing angle from the state where the front surface of the upper slewing body 22 faces the soil mound 100 to the position 93 on the left side in the drawing are different, the target return start point 83 may be moved to the target return point 82 corresponding to the smaller one of the two slewing angles. Although the two slewing angles are the same in FIG. 8, the two stewing angles may be possibly different depending on the direction of the platform 27. In FIG. 8, the target return start point 85 after movement is located upstream of the target return start point 83 before movement in the slewing direction.

Then, the controller 11 resets the target return trajectory 81 to decrease the slewing angle of the upper stewing body 22. In FIG. 8, the slewing angle from the state where the front surface of the upper slewing body 22 faces the soil mound 100 to the target return start point 85 after movement is smaller than the stewing angle to the target return start point 83 before movement.

As described above, in the present embodiment, the target return trajectory 81 of the distal end of the bucket 33 is set between the target return start point 83 at which the operation of moving the attachment 30 that has dropped (released) earth and sand from above the platform 27 toward the soil mound 100 is started and the target return end point 84 at which this operation is finished. Thereafter, the target return start point 83 is moved based on the ambient information imaged by the imaging device 4. After the target return start point 83 is moved and the target return start point 85 is set, the target return trajectory 81 is reset between the target return end point 84 and the target return start point 85 after movement. After the target return trajectory 81 is reset, the distal end of the bucket 33 is operated to follow the target return trajectory 81. Thus, the attachment 30 can be efficiently operated by resetting the target return trajectory 81.

When the platform 27 is located upstream of the target return start point 83 before movement in the slewing direction of the upper slewing body 22, the target return start point 83 is moved to upstream in the slewing direction corresponding to the platform 27. Accordingly, the target return trajectory 81 is reset to decrease the slewing angle of the upper slewing body 22. Therefore, the attachment 30 that has dropped earth and sand can be efficiently moved to the target return start point 85.

Figure 9:
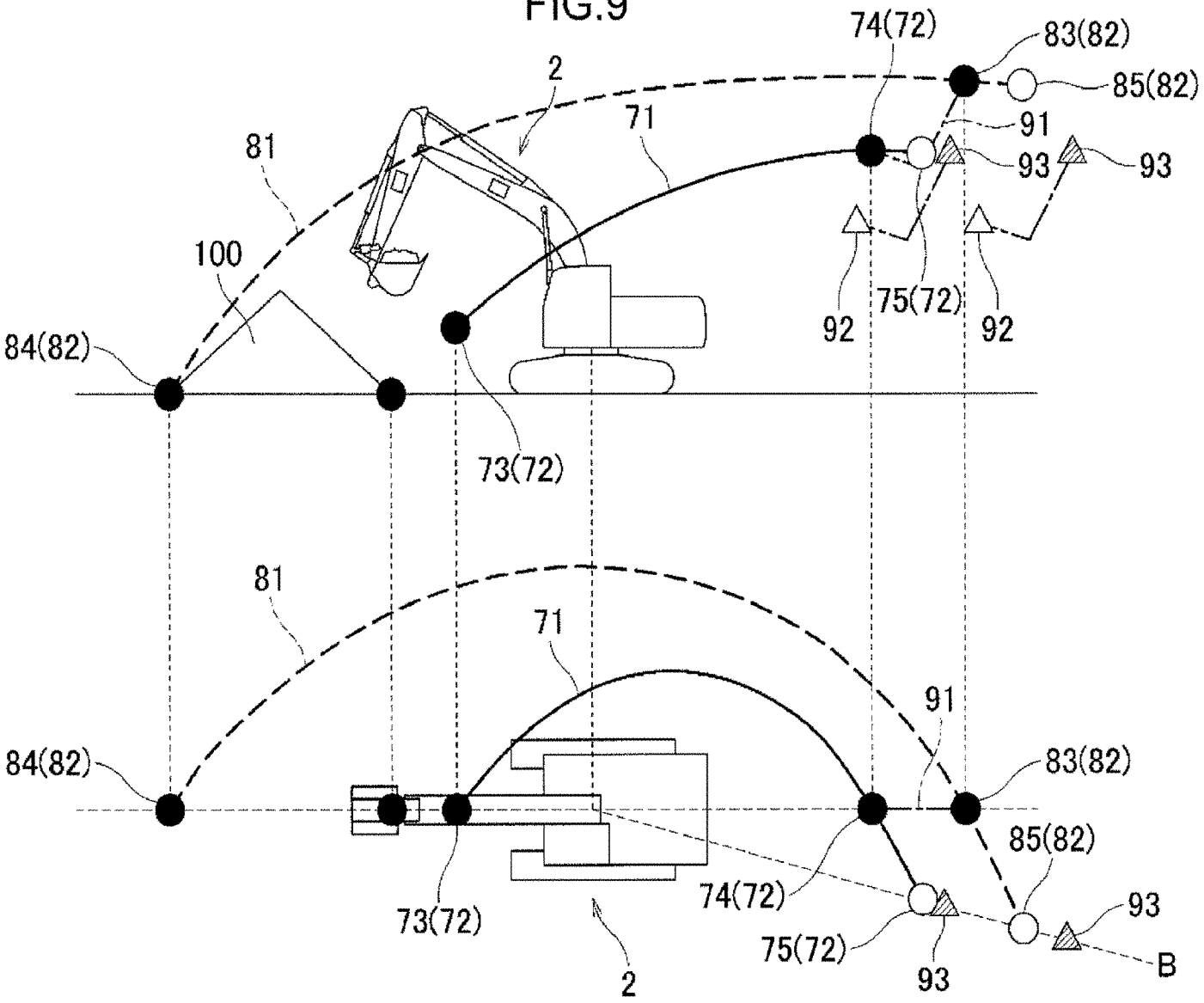
FIG. 9 is a diagram of a target trajectory and a target return trajectory of a distal end of a bucket according to one embodiment of the present invention, and is a diagram in a case where the target return trajectory is reset to increase the slewing angle of the upper slewing body.

FIG. 9 is a diagram of the target trajectory 71 and the target return trajectory 81 of the distal end of the bucket 33. With reference to FIG. 9, a case will be considered where the platform 27 of the dump truck 3 is located downstream of the target return start point 83 before movement in the slewing direction of the upper slewing body 22. In this case, as described above with reference to FIG. 4, the target trajectory 71 is reset. The distal end of the bucket 33 is moved from the target end point 75 after movement to the soil discharging position 92, follows the target soil discharging trajectory 91, and reaches a position 93 indicated by a triangle (▲: hatched Δ). Since the position 93 and the target return start point 83 are separated from each other, moving the distal end of the bucket 33 from the position 93 to the target return start point 83 will be a detour.

Accordingly, the controller 11 moves the target return start point 83 to downstream in the slewing direction of the upper stewing body 22 corresponding to the platform 27. In the present embodiment, the target return start point 83 is moved to the target return point 82 located at the intersection of the straight line connecting the two positions 93 and the target return trajectory 81 to set the target return start point 85. In this case as well, in a case where the slewing angle from the state where the front surface of the upper slewing body 22 faces the soil mound 100 to the position 93 on the right side in the drawing and the slewing angle from the state where the front surface of the upper slewing body 22 faces the soil mound 100 to the position 93 on the left side in the drawing are different, the target return start point 83 may be moved to the target return point 82 corresponding to the smaller one of the two slewing angles. Although the two stewing angles are the same in FIG. 9, the two stewing angles may be possibly different depending on the inclination of the platform 27. In FIG. 9, the target return start point 85 after movement is located downstream of the target return start point 83 before movement in the stewing direction.

Then, the controller 11 resets the target return trajectory 81 to increase the slewing angle of the upper slewing body 22. In FIG. 9, the slewing angle from the front surface of the upper stewing body 22 to the target return start point 85 after movement is larger than the slewing angle from the front surface of the upper slewing body 22 to the target return start point 83 before movement.

In this manner, when the platform 27 is located downstream of the target return start point 83 before movement in the slewing direction of the upper slewing body 22, the target return start point 83 is moved to downstream in the slewing direction corresponding to the platform 27.

Accordingly, the target return trajectory 81 is reset to increase the slewing angle of the upper slewing body 22. Therefore, the attachment 30 that has dropped earth and sand can be efficiently moved to the target return start point 85.

Figure 10:
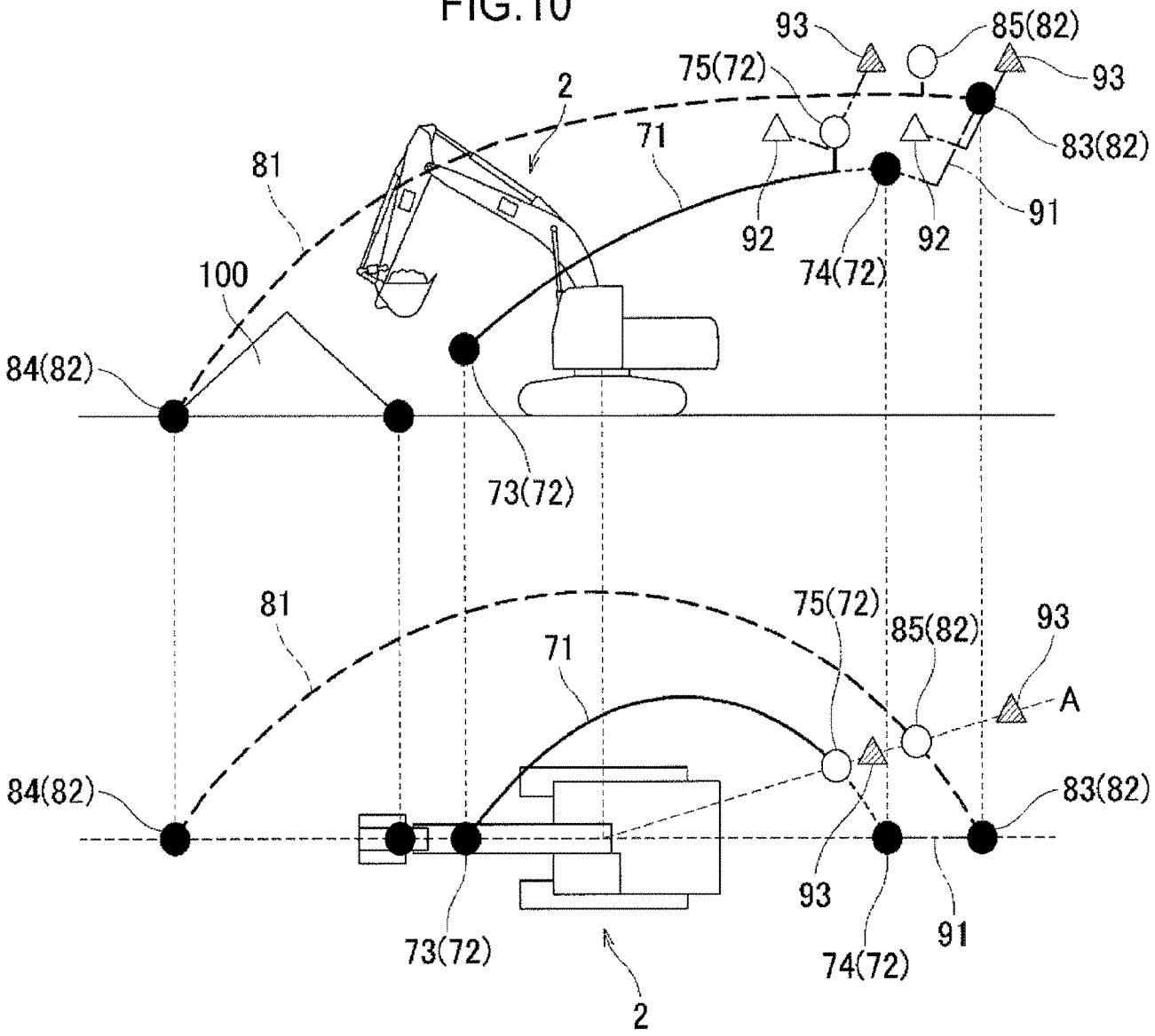
FIG. 10 is a diagram of a target trajectory and a target return trajectory of a distal end of a bucket according to one embodiment of the present invention, and is a diagram in a case where a target return start point is moved to above the upper end of the dump truck.

FIG. 10 is a diagram of the target trajectory 71 and the target return trajectory 81 of the distal end of the bucket 33. With reference to FIG. 10, a case will be considered where the upper end of the platform 27 of the dump truck 3 is located above the target return start point 83 before movement. The distal end of the bucket 33 moves from the target end point 75 after movement to the soil discharging position 92, follows the target soil discharging trajectory 91, and reaches a position 93 indicated by a triangle (▲).

In FIG. 10, as in FIG. 5, since the upper end of the platform 27 is located above the target end point 74 before movement, the target trajectory 71 is reset. In FIG. 10, as in FIG. 5, the platform 27 is located upstream of the target end point 74 before movement in the slewing direction of the upper slewing body 22. Therefore, in FIG. 10, the target end point 75 after movement is located upstream of the target end point 74 before movement in the slewing direction.

In this case, the controller 11 moves the target return start point 83 to above the upper end of the platform 27 to set the target return start point 85. In the present embodiment, the target return start point 85 to above the target return point 82 located at the intersection of the straight line connecting the two positions 93 and the target return trajectory 81. In this case as well, in a case where the slewing angle from the state where the front surface of the upper slewing body 22 faces the soil mound 100 to the position 93 on the right side in the drawing and the slewing angle from the state where the front surface of the upper slewing body 22 faces the soil mound 100 to the position 93 on the left side in the drawing are different, the target return start point 85 may be set to above the target return point 82 corresponding to the smaller one of the two slewing angles. In FIG. 10, the target return start point 85 after movement is located above the target return start point 83 before movement.

In this manner, when the upper end of the platform 27 is located above the target return start point 83 before movement, the target return start point 83 is moved to above the upper end of the platform 27. It is therefore possible to prevent the attachment 30 from coming into contact with the platform 27.

Figure 11:
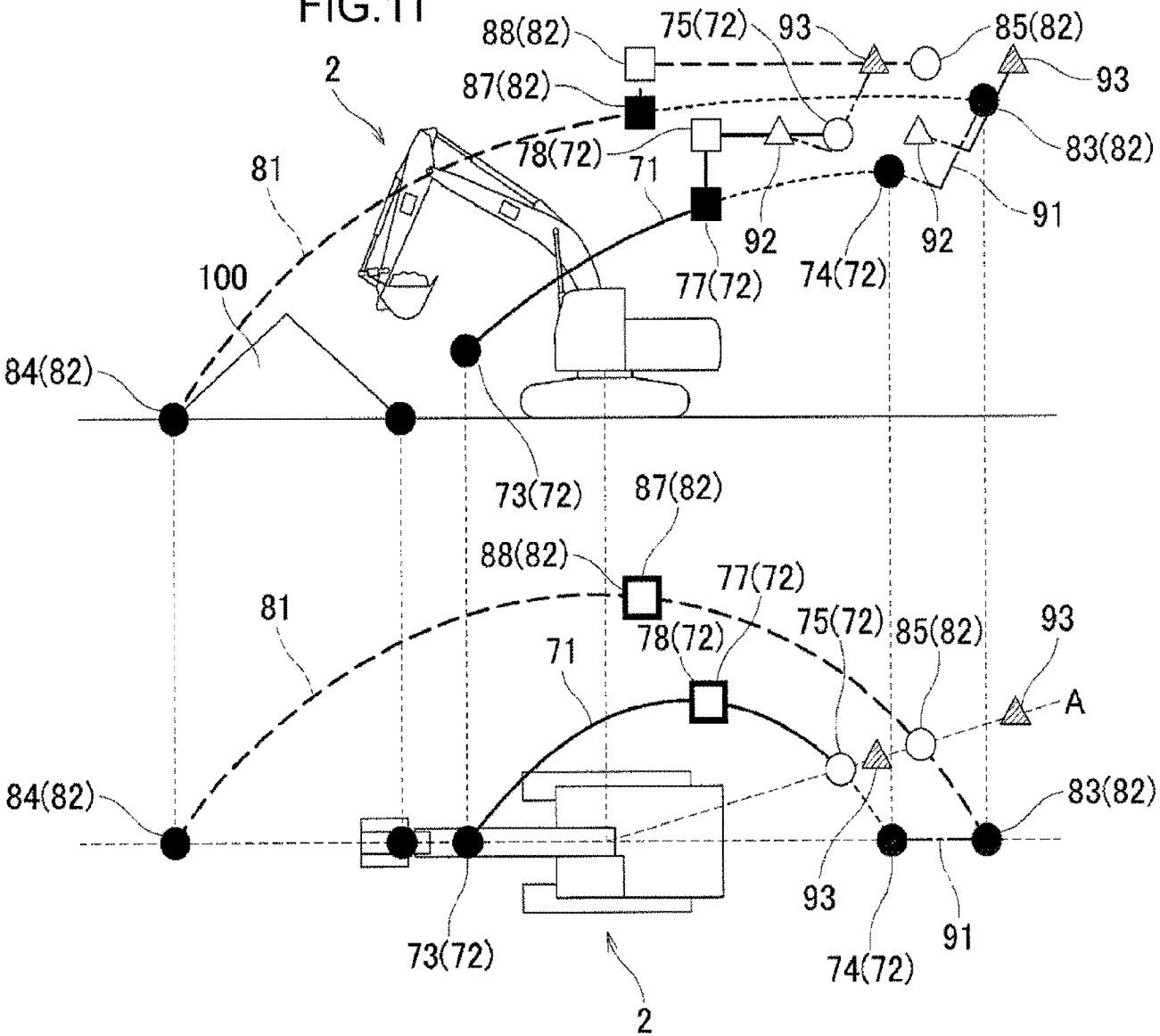
FIG. 11 is a diagram of a target trajectory and a target return trajectory of a distal end of a bucket according to one embodiment of the present invention, and is a diagram in a case where a return avoidance point is set above a return interference point.

FIG. 11 is a diagram of the target trajectory 71 and the target return trajectory 81 of the distal end of the bucket 33. With reference to FIG. 11, a case will be considered where the upper end of the platform 27 of the dump truck 3 is located above the target return start point 83 before movement and the upper end of the platform 27 is located above a return interference point 87. Here, the return interference point 87 is the target return point 82 located closer to the target return end point 84 than the target return start point 83 in the set target return trajectory 81. The return interference point 87 is the target return point 82 determined by the controller 11 to possibly interfere with the platform 27 based on the ambient information imaged by the imaging device 4. The distal end of the bucket 33 moves from the target end point 75 after movement to the soil discharging position 92, follows the target soil discharging trajectory 91, and reaches the position 93 indicated by the triangle (▲: hatched Δ).

In FIG. 11, as in FIG. 6, since the upper end of the platform 27 is located above the target end point 74 and the interference point 77 before movement, the target trajectory 71 is reset. In addition, in FIG. 11, as in FIG. 6, the platform 27 is located upstream of the target end point 74 before movement in the stewing direction of the upper slewing body 22. Therefore, in FIG. 11, the target end point 75 after movement is located upstream of the target end point 74 before movement in the slewing direction.

In this case, the controller 11 moves the target return start point 83 to above the upper end of the platform 27 to set the target return start point 85. In addition, the controller (return avoidance point moving unit) 11 sets a return avoidance point 88 so as to move the return interference point 87 to above the upper end of the platform 27 based on the ambient information by the imaging device 4. In the present embodiment, the return avoidance point 88 is set above the return interference point 87 before movement in the target return trajectory 81. The controller 11 resets the target return trajectory 81 so as to pass through the set return avoidance point 88.

In FIG. 11, the return interference point 87 before movement is indicated by a black square (■), and the return avoidance point 88 having been set instead is indicated by a white square (□). In FIG. 11, the return avoidance point 88 is located above the return interference point 87. The height of the reset target return trajectory 81 is constant between the return avoidance point 88 and the target return start point 85.

Here, as described with reference to FIG. 7, in a case where the return avoidance point 88 is set above the return interference point 87, the controller 11 resets the target return trajectory 81 to connect, by a curve, a portion closer to the target return end point 84 than the return interference point 87 in the set target return trajectory 81 and the set return avoidance point 88. For example, the target return trajectory 81 is reset to connect the target return point 82 upstream of the return interference point 87 by four points and the return avoidance point 88 by a quadratic curve. The shape of the quadratic curve is only required to be determined in a similar manner to the quadratic curve 79 described above.

As described above, in the present embodiment, the controller 11 moves the return interference point 87 located closer to the target return end point 84 than the target return start point 83 in the set target return trajectory 81 based on the ambient information imaged by the imaging device 4, and sets the return avoidance point 88 instead. Then, when the upper end of the platform 27 is located above the return interference point 87 before movement, the return avoidance point 88 is set above the upper end of the platform 27. It is therefore possible to further prevent the attachment 30 from coming into contact with the platform 27.

In addition, the target return trajectory 81 is reset to connect, by a curve, a portion closer to the target return end point 84 than the return interference point 87 in the set target return trajectory 81 and the return avoidance point 88. As a result, since rapid movement of the attachment 30 can be suppressed, it is possible to prevent the attachment 30 from inefficiently moving.

With reference to FIG. 2 again, the work machine side communication device 12 is communicable with a mobile terminal side communication device 16 described later of the mobile terminal 5. The storage 13 can store the target trajectory 71, the target point 72, the target return trajectory 81, and the target return point 82 set by the controller 11.

The controller 11 generates an automatic operation command based on the target trajectory 71, the target point 72, the target return trajectory 81, and the target return point 82. The automatic operation command is a command for automatically operating the slewing device 24 and the attachment 30. Then, the controller 11 can automatically operate the clewing device 24 and the attachment 30 based on the automatic operation command. As a result, the work machine 2 is automatically operated based on the automatic operation command.

As shown in FIG. 2, the mobile terminal 5 includes a mobile terminal side controller 15, a mobile terminal side communication device 16, a mobile terminal side storage 17, and a display 19.

The mobile terminal side communication device 16 is communicable with the work machine side communication device 12 of the work machine 2. That is, the mobile terminal side communication device 16 can transmit and receive various command signals to and from the work machine side communication device 12 of the work machine 2. The mobile terminal side controller 15 receives the target trajectory 71, the target point 72, the target return trajectory 81, and the target return point 82 from the work machine 2 via the mobile terminal side communication device 16.

The display (target trajectory display device) 19 can display the set target trajectory 71 and the reset target trajectory 71 in a superimposed manner. As a result, the worker can visually compare and confirm the set target trajectory 71 and the reset target trajectory 71 by using the mobile terminal 5 located at a place away from the work machine 2, for example.

In addition, the display (target trajectory display device) 19 can display the set target return trajectory 81 and the reset target return trajectory 81 in a superimposed manner. As a result, the worker can visually compare and confirm the set target return trajectory 81 and the reset target return trajectory 81 by using the mobile terminal 5 located at a place away from the work machine 2, for example.

(Setting of Soil Discharging Position)

Figure 12:
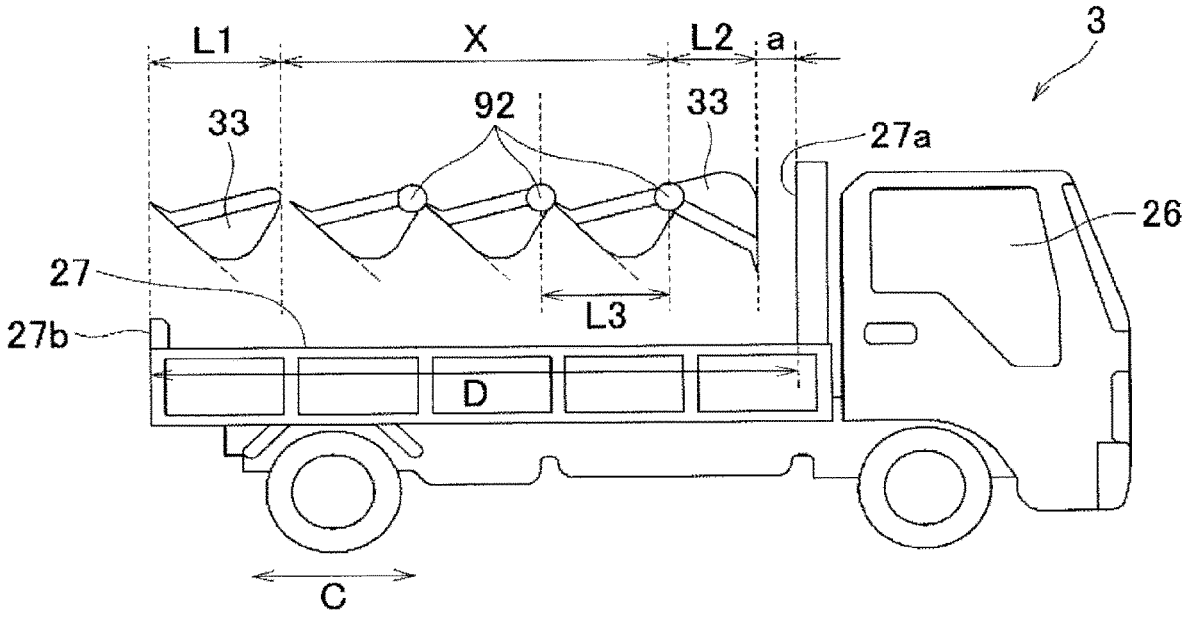
FIG. 12 is a diagram of a dump truck according to one embodiment of the present invention as viewed from a side.

FIG. 12 is a diagram of the dump truck 3 as viewed from a side. With reference to FIG. 12, the platform 27 allowing earth and sand to be loaded is rectangular as viewed from above, and has four sides surrounded by walls. The controller 11 sets the plurality of soil discharging positions (releasing positions) 92 to be arranged along a C direction that connects the wall (wall on the right side in the drawing) 27*a* farthest from the work machine 2 and the wall (wall on the left side in the drawing) 27*b* closest to the work machine 2. At this time, each of the soil discharging positions 92 is desirably set to a position where the distal end of the bucket 33 does not protrude from the platform 27 and the distal end of the bucket 33 does not interfere with the wall.

Here, the length of the platform 27 is defined as D, and a distance between the distal end of the bucket 33 and the wall 27*a* after soil discharge at the position farthest from the work machine 2 is defined as a. The space a is an adjustment value for avoiding contact of the distal end of the discharged bucket 33 with the wall 27*a*. In addition, the width of the bucket 33 in the C direction in an orientation before soil discharge is defined as L1, and the width of the bucket 33 in the C direction in an orientation after soil discharge is defined as L2. In this case, a length X that allows the plurality of soil discharging positions 92 to be set is $D-(L1+L2+a)$. Therefore, when the number of the plurality of soil discharging positions 92 is N, a space L3 between the adjacent soil discharging positions 92 is X/N. In FIG. 12, as an example, three soil discharging positions 92 are set. As described above, FIGS. 3 to 6 and FIGS. 8 to 11 show the soil discharging position 92 closest to the work machine 2 and the soil discharging position farthest from the work machine 2 among the plurality of soil discharging positions 92.

Every time the attachment 30 carries earth and sand of the soil mound 100 to the platform 27, the controller 11 of the work machine 2 sequentially sets the target end point 74 above each soil discharging position 92 of the plurality of soil discharging positions 92. It is therefore possible to release the earth and sand uniformly to the platform 27 while preventing the earth and sand from spilling from the platform 27 and preventing a distal end of the attachment 30 from coming into contact with the wall 27*a*.

EFFECTS

As described above, in the system 1 for setting a target trajectory according to the present embodiment, the controller 11 (target trajectory setting unit) sets the target start point 73 which is a start point of the specific part of the attachment 30 in a first operation of the attachment 30 moving earth and sand (load) acquired from the soil mound 100 (work object) to above the platform 27 (object to be loaded), the target end point 74 which is an end point of the specific part of the attachment 30 in the first operation, and the target trajectory 71 which is a trajectory of the distal end (specific part) of the bucket 33 between the target start point 73 and the target end point 74.

Thereafter, the controller 11 (end point moving unit) can move the target end point 74 set above as necessary based on the ambient information imaged by the imaging device 4. After the target end point 74 is moved, the controller 11 (target trajectory resetting unit) resets the target trajectory 71 between the target start point 73 and the target end point 75 after movement. After the target trajectory 71 is reset, the distal end of the bucket 33 is operated to follow the target trajectory 71. Thus, the attachment 30 can be efficiently operated by resetting the target trajectory 71.

When the platform 27 is located upstream of the target end point 74 before movement in the slewing direction of the upper slewing body 22, the controller 11 (target end point moving unit) moves the target end point 74 to upstream in the slewing direction corresponding to the platform 27. A relative positional relationship between the target end point 74 before movement and the platform 27 is determined by the controller 11 (determiner) based on the ambient information. Accordingly, the target trajectory 71 is reset to decrease the stewing angle of the upper stewing body 22. Therefore, the attachment 30 can be moved to above the platform 27 by adjusting the stewing angle without greatly changing the target trajectory 71.

When the platform 27 is located downstream of the target end point 74 before movement in the stewing direction of the upper slewing body 22, the controller 11 moves the target end point 74 to downstream in the stewing direction corresponding to the platform 27. Accordingly, the target trajectory 71 is reset to increase the stewing angle of the upper stewing body 22. Therefore, the attachment 30 can be moved to above the platform 27 by adjusting the stewing angle without greatly changing the target trajectory 71.

When the upper end of the platform 27 is located above the target end point 74 before movement, the controller 11 moves the target end point 74 to above the upper end of the platform 27. It is therefore possible to prevent the attachment 30 from coming into contact with the platform 27.

In addition, the controller 11 (target trajectory setting unit) sets at least one target point 72 (target passing point) which is a point through which the distal end of the bucket 33 passes between the target start point 73 and the target end point 74 in the target trajectory 71. Then, the controller 11 (avoidance point setting unit) extracts the interference point 77 as a target point likely to interfere with the platform 27 from the at least one target point 72 based on the ambient information, and sets the avoidance point 78 at a position separated from the platform 27 instead of the interference point 77. Then, when the upper end of the platform 27 is located above the interference point 77, the controller 11 sets the avoidance point 78 above the upper end of the platform 27. It is therefore possible to further prevent the attachment 30 from coming into contact with the platform 27.

The controller 11 (target trajectory resetting unit) resets the target trajectory 71 to connect, by a curve, a portion closer to the target start point 73 than the interference point 77 in the target trajectory 71 before resetting and the avoidance point 78. As a result, since rapid movement of the attachment 30 can be suppressed, it is possible to prevent the earth and sand from spilling and the attachment 30 from inefficiently moving.

In addition, the controller 11 (target return trajectory setting unit) sets the target return start point 83 which is a start point of the distal end (specific part) of the bucket 33 in a second specific operation of the attachment 30 releasing earth and sand to the platform 27 and moving from above the platform 27 to the soil mound 100, the target return end point 84 which is an end point of the distal end of the bucket 33 in the second specific operation, and the target return trajectory 81 which is a trajectory of the distal end of the bucket 33 between the target return start point 83 and the target return end point 84.

Thereafter, the controller 11 (return start point moving unit) moves the target return start point 83 set above based on the ambient information imaged by the imaging device 4. After the target return start point 83 is moved, the controller 11 (target return trajectory resetting unit) resets the target return trajectory 81 between the target return start point 85 and the target return end point 84 after movement. After the target return trajectory 81 is reset, the distal end of the bucket 33 is operated to follow the target return trajectory 81. Thus, the attachment 30 can be efficiently operated by resetting the target return trajectory 81.

When the platform 27 is located upstream of the target return start point 83 before movement in the stewing direction of the upper stewing body 22, the controller 11 moves the target return start point 83 to upstream in the slewing direction corresponding to the platform 27. Accordingly, the target return trajectory 81 is reset to decrease the stewing angle of the upper slewing body 22. Therefore, the attachment 30 that has released earth and sand can be efficiently moved to the target return start point 85.

When the platform 27 is located downstream of the target return start point 83 before movement in the slewing direction of the upper slewing body 22, the controller 11 moves the target return start point 83 to downstream in the slewing direction corresponding to the platform 27. Accordingly, the target return trajectory 81 is reset to increase the slewing angle of the upper slewing body 22. Therefore, the attachment 30 that has released earth and sand can be efficiently moved to the target return start point 85.

When the upper end of the platform 27 is located above the target return start point 83 before movement, the controller 11 moves the target return start point 83 to above the upper end of the platform 27. It is therefore possible to prevent the attachment 30 from coming into contact with the platform 27.

In addition, the controller 11 sets at least one target return point 82 (target return passing point) which is a point through which the distal end of the bucket 33 passes between the target return start point 83 and the target return end point 84 in the target return trajectory 81. Then, the controller 11 (return avoidance point setting unit) extracts the return interference point 87 as the target return point 82 likely to interfere with the platform 27 from the at least one target return point 82 based on the ambient information, and sets the return avoidance point 88 at a position separated from the platform 27 instead of the return interference point 87. Then, when the upper end of the platform 27 is located above the return interference point 87 before movement, the controller 11 sets the return avoidance point 88 above the upper end of the platform 27. Furthermore, the controller 11 resets the target return trajectory 81 so as to pass through the set return avoidance point 88. It is therefore possible to further prevent the attachment 30 from coming into contact with the platform 27.

The controller 11 resets the target return trajectory 81 to connect, by a curve, a portion closer to the target return end point 84 than the return interference point 87 in the target return trajectory 81 before resetting and the return avoidance point 88. As a result, since rapid movement of the attachment 30 can be suppressed, it is possible to prevent the attachment 30 from inefficiently moving.

In addition, the display 19 (target trajectory display device) of the mobile terminal 5 can display the set target return trajectory 81 and the reset target return trajectory 81 in a superimposed manner. As a result, the worker can visually compare and confirm the set target return trajectory 81 and the reset target return trajectory 81 by using the mobile terminal 5 located at a place away from the work machine 2, for example.

Furthermore, the display 19 (target trajectory display device) of the mobile terminal 5 can display the set target trajectory 71 and the reset target trajectory 71 in a superimposed manner. As a result, the worker can visually compare and confirm the set target trajectory 71 and the reset target trajectory 71 by using the mobile terminal 5 located at a place away from the work machine 2, for example.

In addition, the platform 27 is provided with the plurality of soil discharging positions 92 at which the attachment 30 releases earth and sand along a direction connecting the wall 27*a* farthest from the work machine and the wall 27*b* closest to the work machine. In other words, the controller 11 (releasing position setting unit) sets the plurality of soil discharging positions 92 (releasing positions) at which the attachment 30 releases earth and sand to be arranged along a direction away from the work machine based on the ambient information imaged by the imaging device 4. Each of the plurality of soil discharging positions 92 is set at a position where the distal end of the attachment 30 does not protrude from the platform 27 and the distal end of the attachment 30 does not interfere with the wall 27*a*. The target end point 74 is set above the soil discharging position 92 of the plurality of soil discharging positions 92 sequentially. That is, when the work machine 2 repeatedly executes the first specific operation, the controller 11 (target trajectory setting unit) sets the target end point 74 above one of the plurality of soil discharging positions 92 for one of the first specific operations, and sets the target end point 74 above each of the plurality of releasing positions so that the target end point 74 sequentially moves along the direction every time the first specific operation is repeated. It is therefore possible to release the earth and sand uniformly to the platform 27 while preventing the earth and sand from spilling from the platform 27 and preventing a distal end of the attachment 30 from coming into contact with the wall 27*a*.

Although the embodiment of the present invention has been described above, it is merely an example, and the present invention is not limited, and a specific configuration and the like can be modified in design as appropriate. The actions and effects described in the embodiments of the present invention merely enumerate the most suitable actions and effects resulting from the present invention, and the actions and effects of the present invention are not limited to those described in the embodiments of the present invention.

For example, in the above embodiment, the controller 11 of the work machine 2 sets the target trajectory 71, moves the target end point 74, and resets the target trajectory 71, but a server (not shown) may execute the above as a part of the system for setting a target trajectory of the present invention. Similarly, in the above embodiment, the controller 11 of the work machine 2 sets the target return trajectory 81, moves the target return start point 83, and resets the target return trajectory 81, but a server (not shown) may execute the above.

In the above embodiment, the display 19 of the mobile terminal 5 has been described as each display device, but each display device of the present invention may be a display device provided in the cab 23 of the work machine 2, a monitor connected to a server (not shown), or the like.

In the present invention, the target trajectory of the specific part of the attachment is set between the target start point at which the operation of moving the attachment holding the load extracted from the work object to above the object to be loaded is started and the target end point at which this operation is finished. Thereafter, the target end point is moved based on the ambient information imaged by the imaging device. After the target end point is moved, the target trajectory is reset between the target start point and the target end point after movement. After the target trajectory is reset, the specific part of the attachment is operated to follow this target trajectory. Thus, the attachment can be efficiently operated by resetting the target trajectory.

The invention claimed is:

1. A system for setting a target trajectory of an attachment, the system being used in a work machine including a lower travelling body, an upper slewing body slewably attached on the lower travelling body, and an attachment attached to the upper slewing body, the system comprising:

a target trajectory setting unit that sets a target start point which is a start point of a specific part of the attachment in a first specific operation of the attachment moving a load acquired from a work object to above an object to be loaded, a target end point which is an end point of the specific part in the first specific operation, and a target trajectory which is a trajectory of the specific part between the target start point and the target end point;

an imaging device configured to capture an image of surroundings of the work machine including at least the object to be loaded as ambient information;

an end point moving unit configured to move the target end point set by the target trajectory setting unit based on the ambient information imaged by the imaging device; and a target trajectory resetting unit that resets the target trajectory between the target start point and the target end point after movement.

2. The system for setting a target trajectory of an attachment according to claim 1, wherein the end point moving unit moves the target end point to upstream in a slewing direction when the object to be loaded is located upstream of the target end point before movement in the slewing direction of the upper slewing body.

3. The system for setting a target trajectory of an attachment according to claim 1, wherein the end point moving unit moves the target end point to downstream in a slewing direction when the object to be loaded is located downstream of the target end point before movement in the slewing direction of the upper slewing body.

4. The system for setting a target trajectory of an attachment according to claim 1, wherein the end point moving unit moves the target end point to above an upper end of the object to be loaded when the upper end of the object to be loaded is located above the target end point before movement.

5. The system for setting a target trajectory of an attachment according to claim 4, wherein the target trajectory setting unit sets at least one target passing point which is a point through which the specific part passes between the target start point and the target end point in the target trajectory, the system further includes an avoidance point setting unit that extracts an interference point which is the target passing point likely to interfere with the object to be loaded from the at least one target passing point based on the ambient information and sets an avoidance point at a position separated from the object to be loaded instead of the interference point, the avoidance point setting unit sets the avoidance point above the upper end of the object to be loaded when the upper end of the object to be loaded is located above the interference point, and the target trajectory resetting unit resets the target trajectory to pass through the avoidance point.

6. The system for setting a target trajectory of an attachment according to claim 5, wherein the target trajectory resetting unit resets the target trajectory to connect, by a curve, a portion closer to the target start point than the interference point in the target trajectory before resetting and the avoidance point.

7. The system for setting a target trajectory of an attachment according to claim 1, further comprising:

a target return trajectory setting unit that sets a target return start point which is a start point of the specific part in a second specific operation of the attachment releasing the load to the object to be loaded and moving from above the object to be loaded to the work object, a target return end point which is an end point of the specific part in the second specific operation, and a target return trajectory which is a trajectory of the specific part between the target return start point and the target return end point;

a return start point moving unit configured to move the target return start point set by the target return trajectory setting unit based on the ambient information; and a target return trajectory resetting unit that resets the target return trajectory between the target return start point and the target return end point after movement.

8. The system for setting a target trajectory of an attachment according to claim 7, wherein the return start point moving unit moves the target return start point to upstream in the slewing direction when the object to be loaded is located upstream of the target return start point before movement in the slewing direction of the upper slewing body.

9. The system for setting a target trajectory of an attachment according to claim 7, wherein the return start point moving unit moves the target return start point to downstream in the slewing direction when the object to be loaded is located downstream of the target return start point before movement in the slewing direction of the upper slewing body.

10. The system for setting a target trajectory of an attachment according to claim 7, wherein the return start point moving unit moves the target return start point to above the upper end of the object to be loaded when the upper end of the object to be loaded is located above the target return start point before movement.

11. The system for setting a target trajectory of an attachment according to claim 10, wherein the target return trajectory setting unit sets at least one target return passing point which is a point through which the specific part passes between the target return start point and the target return end point in the target return trajectory, the system further includes a return avoidance point setting unit that extracts a return interference point which is the target return passing point likely to interfere with the object to be loaded from the at least one target return passing point based on the ambient information and sets a return avoidance point at a position separated from the object to be loaded instead of the return interference point, the return avoidance point setting unit sets the return avoidance point above the upper end of the object to be loaded when the upper end of the object to be loaded is located above the return interference point, and the target return trajectory resetting unit resets the target return trajectory to pass through the return avoidance point.

12. The system for setting a target trajectory of an attachment according to claim 11, wherein the target return trajectory resetting unit resets the target return trajectory to connect, by a curve, a portion closer to the target return end point than the return interference point in the target return trajectory before resetting and the return avoidance point.

13. The system for setting a target trajectory of an attachment according to claim 7, further comprising a target return trajectory display device configured to display the target return trajectory having been set and the target return trajectory having been reset in a superimposed manner.

14. The system for setting a target trajectory of an attachment according to claim 1, further comprising a target trajectory display device configured to display the target trajectory having been set and the target trajectory having been reset in a superimposed manner.

15. The system for setting a target trajectory of an attachment according to claim 1, further comprising a releasing position setting unit that sets a plurality of releasing positions at which the attachment releases the load to be arranged along a direction away from the work machine based on the ambient information imaged by the imaging device, wherein each of the plurality of releasing positions is set at a position where a distal end of the attachment does not protrude from the object to be loaded and the distal end of the attachment does not interfere with the object to be loaded, and when the work machine repeatedly executes the first specific operation, the target trajectory setting unit sets the target end point above one releasing position of the plurality of releasing positions for one of the first specific operation, and sets the target end point above the plurality of releasing positions so that the target end point sequentially moves along the direction every time the first specific operation is repeated.

* * * * *